US008528356B2

(12) United States Patent
Junge et al.

(10) Patent No.: US 8,528,356 B2
(45) Date of Patent: Sep. 10, 2013

(54) AUGER STYLE ICE MAKER AND REFRIGERATION APPLIANCE INCORPORATING SAME

(75) Inventors: Brent Alden Junge, Evansville, IN (US); Russell James Fallon, Louisville, KY (US); Alan Joseph Mitchell, Louisville, KY (US)

(73) Assignee: General Electric Company, Schenectady, NY (US)

( * ) Notice: Subject to any disclaimer, the term of this patent is extended or adjusted under 35 U.S.C. 154(b) by 364 days.

(21) Appl. No.: 12/908,108

(22) Filed: Oct. 20, 2010

(65) Prior Publication Data

US 2012/0096889 A1 Apr. 26, 2012

(51) Int. Cl.
*F25C 5/02* (2006.01)

(52) U.S. Cl.
USPC ..... 62/320; 62/345; 62/356

(58) Field of Classification Search
USPC ..... 62/320, 75, 353–356
See application file for complete search history.

(56) References Cited

U.S. PATENT DOCUMENTS 3,175,369 A * 3/1965 Murphy et al. ..... 62/3.63
3,342,040 A * 9/1967 Dedricks et al. ..... 62/320
3,984,996 A * 10/1976 Bright ..... 62/353
4,429,551 A * 2/1984 Hizume ..... 62/354
6,082,121 A 7/2000 Marsh et al.
6,220,038 B1 4/2001 Marsh et al.
6,223,550 B1 5/2001 Marsh et al.
6,370,904 B2 4/2002 Tchougounov et al.
6,470,701 B2 10/2002 Tchougounov et al.
6,490,873 B2 12/2002 Tchougounov et al.
6,526,763 B2 3/2003 Tchougounov et al.
6,640,565 B2 11/2003 Tchougounov et al.
2001/0011460 A1 8/2001 Tchougounov et al.
2001/0011461 A1 8/2001 Tchougounov et al.
2002/0007638 A1 1/2002 Tchougounov et al.
2002/0108383 A1 8/2002 Tchougounov et al.

* cited by examiner

*Primary Examiner* — Cassey D Bauer
(74) *Attorney, Agent, or Firm* — Dority & Manning, P.A.

(57) ABSTRACT

An ice making assembly includes a mold configured for forming an ice cube. The mold has a base, a side wall, and an opening in the side wall spaced from the base. An auger has a shaft with a proximal end above and outside of the mold, a distal end within the mold, and a central section between the distal end and the proximal end and extending through the opening. The auger further has a threaded portion configured for moving the ice cube out of the mold through the opening via rotation of the auger. A motor may be located above the mold and attached to the proximal end of the shaft for rotating the auger to lift the ice cube from the mold. The ice cubes may be formed with a gap and a splitter may split the ice cubes at the gap.

16 Claims, 6 Drawing Sheets

AUGER STYLE ICE MAKER AND REFRIGERATION APPLIANCE INCORPORATING SAME

FIELD OF THE INVENTION

The subject matter disclosed herein relates generally to single ice cube makers using an auger to remove the ice cube from a mold wherein leakage through the mold is prevented.

BACKGROUND OF THE INVENTION

Various ice maker designs have been proposed for refrigeration appliances such as commercial or home refrigerators and/or freezers. In certain compact refrigeration appliances, space is at a premium within the refrigeration cabinet. Accordingly, traditional ice makers where a plurality of ice cubes are made simultaneously within a number of ice cube molds and then harvested to an ice bucket may not be suitable for such compact devices.

One type of ice maker suggested for compact refrigeration appliances is known as an auger style ice maker. In such ice makers, a single ice cube is made at a time in an ice cube mold. An auger extends upward from within the ice cube mold with a distal end above the mold. Rotation of the auger lifts the ice cube up out of the mold toward the distal end. The motor or other gearing for driving the auger are connected to the distal end of the auger, with some sort of interconnection through the base of the mold. U.S. Pat. Nos. 6,082,121, 6,470,701 and U.S. Pat. No. 6,490,873 all disclose such compact auger style ice makers.

Due to the connection of the motor drive through the base of the mold, a seal must be present at the base to prevent leakage of water down through the mold. However, in such an environment where water is repeatedly frozen into ice, the ice cube is removed mechanically via rotation, and then water refills the mold, leakage of water from the mold at the seal interface is possible. That water will then likely travel further into the refrigeration appliance, either onto the motor and/or gears or beyond. The water may pool in a refrigerated location or may freeze if in a cold enough location. Accordingly, an improved auger type ice maker that avoids leakage issues as described above would be welcome.

BRIEF DESCRIPTION OF THE INVENTION

Aspects and advantages of the invention will be set forth in part in the following description, or may be obvious from the description, or may be learned through practice of the invention.

According to certain aspects of the disclosure, an ice making assembly includes a mold configured for forming an ice cube. The mold has a base, a side wall attached to the base, and an opening in the side wall spaced from the base. An auger removes the ice cube from the mold. The auger has a shaft with a proximal end outside of the mold, a distal end within the mold, and a central section between the distal end and the proximal end and extending through the opening. The auger further has a threaded portion configured for moving the ice cube out of the mold through the opening via rotation of the auger. Various options and modifications are possible.

According to certain other aspects of the disclosure, an ice making assembly includes a mold configured for forming an ice cube. The mold has a base, a side wall attached to the base, an opening in the side wall spaced from the base, and at least one dividing wall at least partially within the side wall for forming a gap within the ice cube. An auger removes the ice cube from the mold. The auger has a shaft with a proximal end outside of the mold, a distal end within the mold, and a central section between the distal end and the proximal end and extending through the opening. The auger further has a threaded portion configured for moving the ice cube out of the mold through the opening via rotation of the auger. An ice cube splitter is located outside of the mold configured for splitting the ice cube at the gap as the auger moves the ice cube. As above, various options and modifications are possible.

According to still other aspects of the disclosure, a refrigeration appliance includes a refrigerated compartment and includes a mold within the refrigerated compartment configured for forming an ice cube. The mold has a base, a side wall formed continuously and unitarily with the base, and an opening in the side wall spaced from the base. An auger has a shaft with a proximal end above and outside of the mold, a distal end within the mold, and a central section between the distal end and the proximal end and extending through the opening. The auger further has a threaded portion configured for moving the ice cube out of the mold through the opening via rotation of the auger. A motor is located above the mold and attached to the proximal end of the shaft for rotating the auger to lift the ice cube from the mold. Again, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
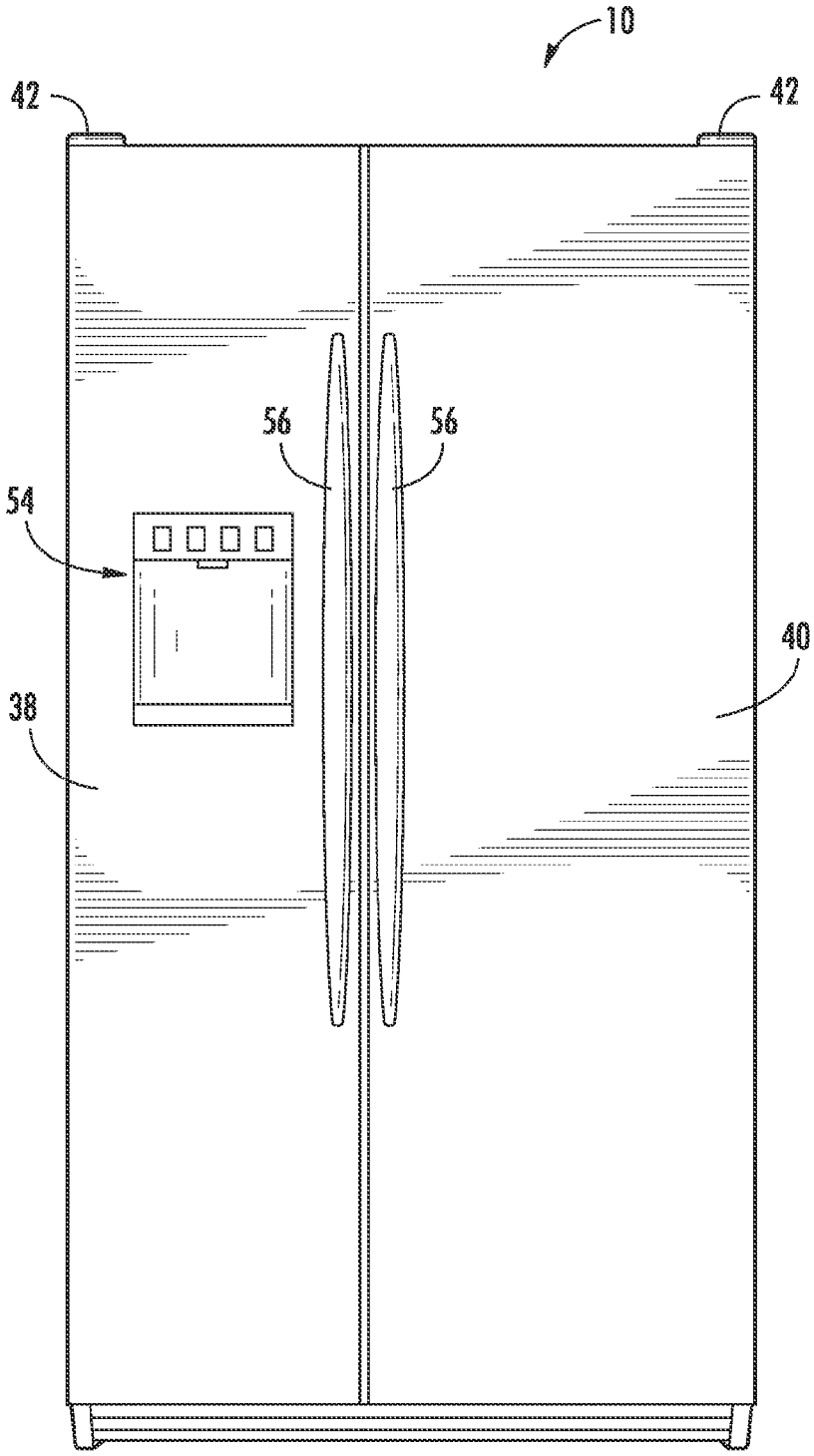
FIG. 1 provides a front view of a refrigeration appliance with its doors closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a frontal view of an exemplary refrigeration appliance 10 depicted as a refrigerator in which dispenser target indicating assemblies in accordance with aspects of the present invention may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth. The present disclosure may be especially suitable for a compact refrigerator and/or freezer appliance where space is at a premium and an ice-making capability is desired. However, the disclosed ice-making assembly may be used with any such appliance.

Figure 2:
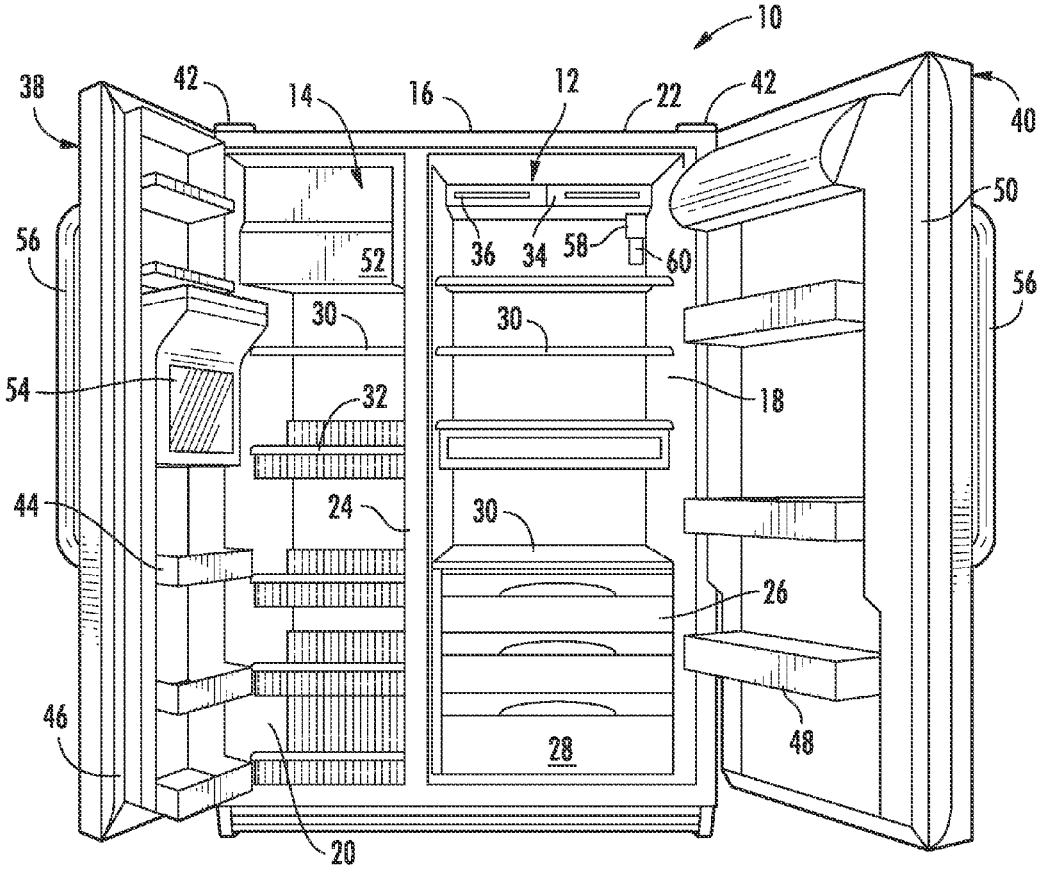
FIG. 2 provides a front view of the refrigeration appliance of FIG. 1 with its doors opened.
Figure 3:
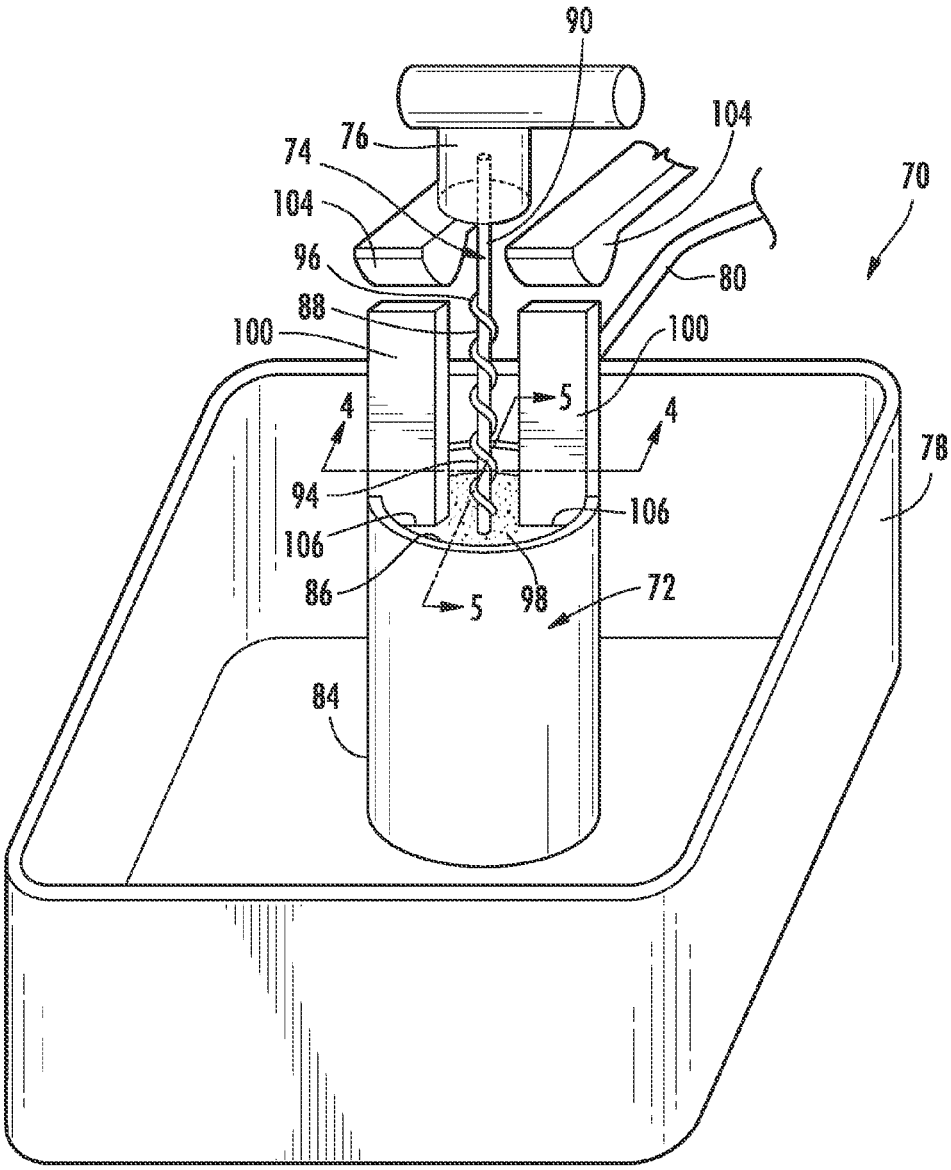
FIG. 3 provides a perspective view of an ice making assembly according to certain aspects of the present disclosure.
Figure 4:
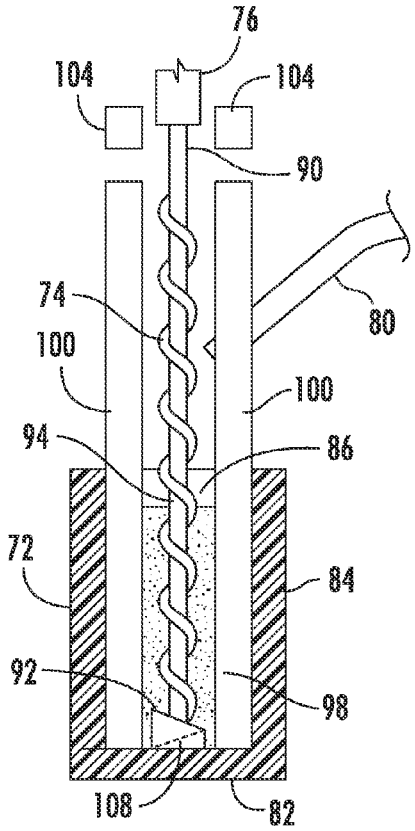
FIG. 4 provides a cross-sectional view of a portion of the assembly of FIG. 3 taken along line 4-4.
Figure 5:
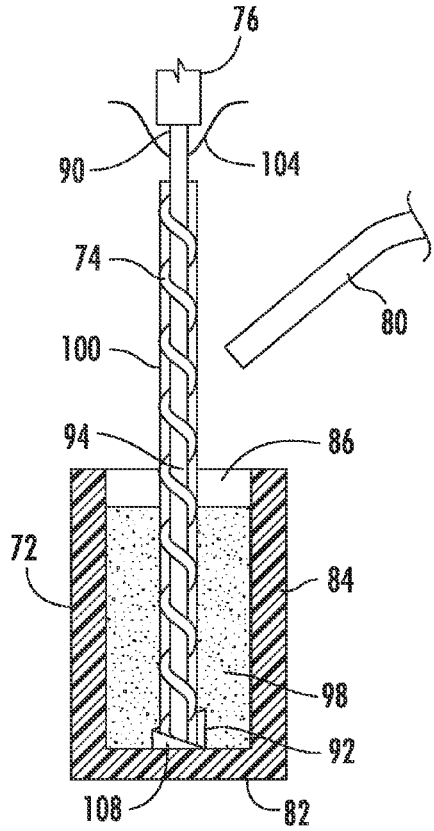
FIG. 5 provides an alternate cross-sectional view of a portion of the assembly of FIG. 3 taken along line 5-5.

Referring to FIG. 2 the refrigerator 10 includes a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Slide-out drawers 26, a storage bin 28 and shelves 30 are normally provided in fresh food storage compartment 12 to support items being stored therein. In addition, at least one shelf 30 and at least one wire basket 32 are also provided in freezer storage compartment 14.

The refrigerator features are controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between an open position, as shown in FIG. 1, and a closed position. The freezer door 38 may include a plurality of storage shelves 44 and a sealing gasket 46, and fresh food door 40 also includes a plurality of storage shelves 48 and a sealing gasket 50.

The freezer storage compartment 14 may include an automatic ice maker 52 and a dispenser 54 provided in the freezer door 38 such that ice and/or chilled water can be dispensed without opening the freezer door 38, as is well known in the art. Doors 38 and 40 may be opened by handles 56 is conventional. A housing 58 may hold a water filter 60 used to filter water for the ice maker 52 and/or dispenser 54.

As with known refrigerators, the refrigerator 10 also includes a machinery compartment (not shown) that at least partially contains components for executing a known vapor compression cycle for cooling air. The components include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to directly cool the ice maker to form ice cubes, and a heating loop can be added to help remove ice from the ice maker. Collectively, the vapor compression cycle components in a refrigeration circuit, associated fans, and associated compartments are conventionally referred to as a sealed system. The construction and operation of the sealed system are well known to those skilled in the art.

FIGS. 3-7 show one example of an ice making assembly 70 according to certain aspects of the disclosure. Ice making assembly 70 could comprise a device such as ice maker 52 as shown above or could comprise a device in another location or refrigeration appliance.

As shown, ice making assembly includes a mold 72, an auger 74 and a motor assembly 76 for driving the auger. The motor assembly 76 may have gearing and the like for stepping down rotation to a desired rotation rate for auger 74. Mold 72 is placed in or above a representative container 78 such as an ice bucket. Container 78 may be removable or fixed in place, or may have conventional emptying equipment such as augers, trap doors, etc., as desired in an application. A water source 80 provides water to mold 72 periodically.

Mold 72 includes a base 82, a side wall 84 and an opening 86 in the side wall spaced from the base. As shown, opening 86 is at a top of mold 72 facing upward. Water fills mold 72 and ice cubes exit the mold through opening 86. Mold 72 can be air-cooled or direct-cooled if desired.

Auger 74 includes a shaft 88 with a proximal end 90 outside mold 72, a distal end 92 inside the mold and a central section 94 between the ends and extending though opening 86. Auger 74 includes a threaded portion 96 configured for moving an ice cube 98 out of mold 72 via rotation of the auger.

Proximal end 90 of auger 74 is attached to motor assembly 76. By placing motor assembly 76 above the mold (rather than below it with the auger extending through base 82), no seals between moving surfaces or potential other leakage paths are present at the mold 72. Base 82 and side wall 84 can be formed unitarily if desired to further prevent leakage paths.

Mold 72 can include various structures to assist in removal of ice cube 98 from the mold. For example, mold 72 may include at least one dividing wall 100 at least partially within side wall 84 for forming a gap 106 within ice cube 98. As shown, two such walls 100 may be provided. If desired, such structure may extend out of opening 86 above mold 72. Such non-symmetrical structure may help move ice cube 98 out of mold 72 by preventing rotation of the ice cube relative to the mold when auger 74 rotates, thereby moving the ice cube up the auger and out of the mold. Further, walls 100 provide preselected fracture locations for ice-cube 98 at gaps 106 to assist in removing ice cubes from auger 74.

Figure 6:
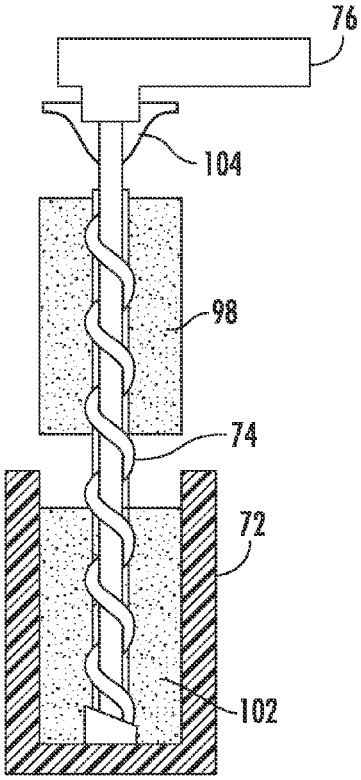
FIG. 6 provides a cross-sectional diagrammatical view of the assembly as in FIG. 3, showing one ice cube forming and one ice cube finishing.

If desired, as shown in FIG. 6, a first ice cube 98 may be lifted from mold 72 for finishing in a cold temperature environment while a second ice cube 102 is being formed in mold 72. Doing so can increase the ice cube making rate.

Figure 7:
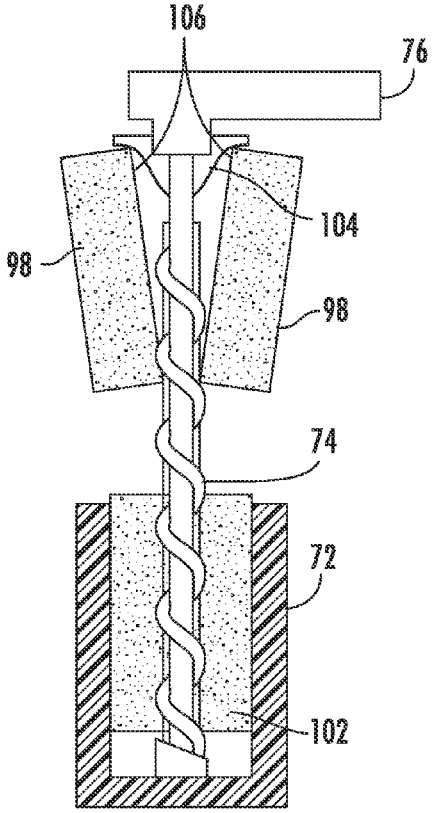
FIG. 7 provides a cross-sectional diagrammatical view as in FIG. 6, with the auger being rotated to move the ice cubes upward.

If desired, a splitter structure may also be provided to help remove ice cubes from auger 74. As shown, wedge members 104 are provided above walls 100. When ice cubes 98 are driven upward far enough, they contact wedge members 104 and split at gaps 106 in the ice cubes caused by formation of the ice cube adjacent to walls 100 of mold 72. FIGS. 6 and 7 show such process, whereby ice cubes 98 and 102 are driven upward by rotation of auger 74, and ice cube 98 splits along gaps 106. If desired, a lifting cam 108 can be located on a distal end of auger 74 to assist in initially lifting ice cubes 98 out of mold 72.

Figure 8:
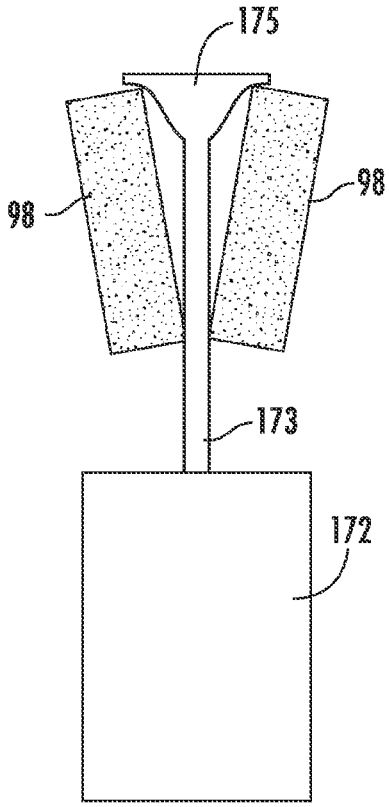
FIG. 8 provides a side view of an ice making assembly with an alternate ice cube splitter.
Figure 9:
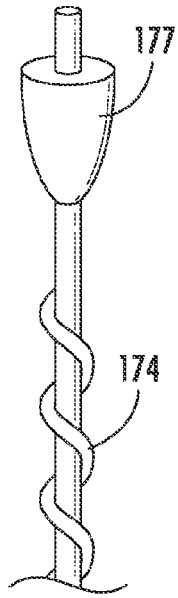
FIG. 9 provides a partial perspective view an auger for an ice making assembly with another alternate ice cube splitter.
Figure 10:
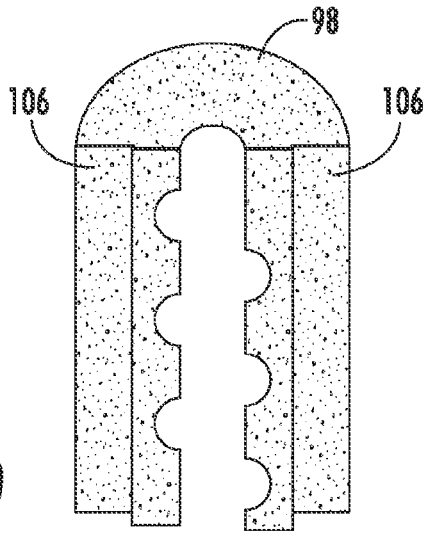
FIG. 10 provides a perspective view of a split ice cube formed by any of the above assemblies.

Alternate splitter designs may be employed. For example, FIG. 8 shows an alternate mold 172 having walls 173 with wedge members 175 at a top end. Therefore, wedge members 175, walls 173 and mold 172 can all be formed integrally. Alternately, walls 173 could taper more gradually outward from mold 172 upward or have other shapes for assisting in splitting ice cubes. FIG. 9 shows an enlarged portion 177 of auger 174 near where the auger is connected to a motor (not shown in FIG. 9). Enlarged portion 177 will cause ice cubes to split when driven upward to that point, thereby avoiding the need to place a wedge portion on a wall or other surface as in the previous embodiments. Similarly, auger 174 could taper more gradually outward in an upward direction or have other shapes to assist in splitting ice cubes.

Accordingly, in view of the above, various types and options for compact single cube type ice makers are disclosed. An auger raises the ice cube upward out of the mold when ready. By mounting the auger from above and not piercing the mold from below, there are no leakage paths in the mold and no moving parts to seal between. The ice cube maker of the various above designs can operates according to conventional methods by controller 34. Optional sensors, controls, etc. can be provided. Ice cube making can be commenced on a timed schedule wherein an ice cube is moved up out of the mold for finishing or directly driven until it fractures off the auger, whether or not a splitter is employed. Water can then be provided to the mold from the water source to begin the cycle again. A full bucket sensor can be employed to stop the ice making process.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly comprising:

a mold configured for forming an ice cube, the mold having a base, a side wall attached to the base, and an opening where the ice cube is dispensed from the mold, the opening spaced from the base;

an auger for removing the ice cube from the mold, the auger having a shaft with a proximal end outside of the mold, a distal end within the mold, and a central section between the distal end and the proximal end and extending through the opening, the auger being sufficiently spaced from the side wall so that the ice cube fauns within the side wall and base, the auger further having a threaded portion configured for moving the formed ice cube out of the mold through the opening via rotation of the auger;

wherein, the mold defines an inner width and the auger defines an outer width, the inner width of the mold being at least twice as large as the inner width of the auger so that the ice cube forms between the mold and the auger;

the mold further includes at least two dividing walls, the at least two dividing walls positioned on the side wall of the mold for forming gaps within the ice cube, the at least two dividing walls extending through the opening of the mold toward the proximal end of the shaft.

2. The ice making assembly of claim 1, wherein the shaft is sized so that the auger can lift ice cubes upwardly from the mold via the opening.

3. The ice making assembly of claim 2, wherein the ice cube comprises a first ice cube and the shaft is sized so that the first ice cube can be disposed on the shaft outside of the mold for finishing while a second ice cube is formed in the mold.

4. The ice making assembly of claim 1, further including an ice cube splitter located outside of the mold configured for splitting the ice cube.

5. The ice making assembly of claim 4, wherein the ice cube splitter includes a thickened portion of the shaft.

6. The ice making assembly of claim 4, wherein the ice cube splitter includes a wedge located outside of the side wall.

7. The ice making assembly of claim 6, wherein the wedge is located on a portion of at least one of the at least two dividing walls extending from within the side walls to outside of the mold.

8. The ice making assembly of claim 6, wherein the wedge is spaced from at least one of the at least two dividing walls extending from within the side walls to outside of the mold.

9. The ice making assembly of claim 1, wherein the auger includes a lifting cam at the distal end of the auger for lifting the ice cube from the base of the mold.

10. An ice making assembly comprising:

mold configured for forming an ice cube, the mold having a base, a side wall attached to the base, an opening where the ice cube is dispensed from the mold, the opening spaced from the base, and at least two dividing walls, the at least two dividing walls positioned on the side wall of the mold for forming gaps within the ice cube the at least two dividing walls extending through the opening of the mold toward the proximal end of the shaft;

an auger for removing the ice cube from the mold, the auger having a shaft with a proximal end outside of the mold, a distal end within the mold, and a central section between the distal end and the proximal end and extending through the opening, the auger being sufficiently spaced from the side wall so that the ice cube forms within the side wall and base, the auger further having a threaded portion configured for moving the formed ice cube out of the mold through the opening via rotation of the auger, the shaft having a length between the proximal and distal ends of the shaft, the length of the shaft being sufficient to permit the auger to support a first ice cube outside of the mold adjacent the proximate end of the shaft and a second ice cube within the mold adjacent the distal end of the shaft; and an ice cube splitter located outside of the mold configured for splitting the ice cube at the gap as the auger moves the ice cube.

11. The ice making assembly of claim 10, wherein the ice cube splitter includes a thickened portion of the shaft.

12. The ice making assembly of claim 10, wherein the ice cube splitter includes a wedge located outside of the side wall.

13. The ice making assembly of claim 10, wherein the auger includes a lifting cam at the distal end of the auger for lifting the ice cube from the base of the mold.

14. A refrigeration appliance comprising:

a refrigerated compartment;

a mold within the refrigerated compartment configured for forming an ice cube, the mold having a base, a side wall formed continuously and unitarily with the base, and an opening where the ice cube is dispensed from the mold, the opening spaced from the base;

an auger having a shaft with a proximal end above and outside of the mold, a distal end within the mold, and a central section between the distal end and the proximal end and extending through the opening, the auger being sufficiently spaced from the side wall so that the ice cube forms within the side wall and base, the auger further having a threaded portion configured for moving the formed ice cube out of the mold through the opening via rotation of the auger; and a motor located above the mold and attached to the proximal end of the shaft for rotating the auger to lift the ice cube from the mold;

wherein, the mold defines an inner width and the auger defines an outer width, the inner width of the mold being at least twice as large as than the inner width of the auger so that the ice cube forms between the mold and the auger;

the mold further including at least two dividing walls, the at least two dividing walls positioned on the side wall of the mold for forming gaps within the ice cube, the at least two dividing walls extending through the opening of the mold toward the proximal end of the shaft.

15. The refrigeration appliance of claim 14, further including an ice cube splitter located outside of the mold configured for splitting the ice cube at the gap.

16. The refrigeration appliance of claim 14, wherein the auger includes a lifting cam at the distal end of the auger for lifting the ice cube from the base of the mold.

* * * * *

UNITED STATES PATENT AND TRADEMARK OFFICE

CERTIFICATE OF CORRECTION

PATENT NO. : 8,528,356 B2
APPLICATION NO. : 12/908108
DATED : September 10, 2013
INVENTOR(S) : Brent Alden Junge, Russell James Fallon and Alan Joseph Mitchell It is certified that error appears in the above-identified patent and that said Letters Patent is hereby corrected as shown below:

In the Claims

Claim 1, Column 6, Line 12 reads "...the ice cube fauns within the side wall and base..." should read --...the ice cube forms within the side wall and base...--

Signed and Sealed this
Fourth Day of March, 2014

Michelle K. Lee

Michelle K. Lee
*Deputy Director of the United States Patent and Trademark Office*